United States Patent [19]

Siegel

[11] 4,019,570

[45] Apr. 26, 1977

[54] HEATING AND COOLING APPARATUS

[76] Inventor: Sidney Siegel, 989 Schenectady Ave., Brooklyn, N.Y. 11203

[22] Filed: July 9, 1975

[21] Appl. No.: 594,228

Related U.S. Application Data

[62] Division of Ser. No. 447,784, March 4, 1974, Pat. No. 3,908,750.

[52] U.S. Cl. ..... 165/67; 165/76; 165/178

[51] Int. Cl.[2] ..... F28F 9/00

[58] Field of Search ..... 165/67, 76, 178, 47

[56] References Cited

UNITED STATES PATENTS

| | | | |
|---|---|---|---|
| 1,903,125 | 3/1933 | Modine | 165/67 |
| 1,920,562 | 8/1933 | Jaffe | 165/67 |
| 2,703,702 | 3/1955 | Meinel | 165/67 |
| 3,422,884 | 1/1969 | Otten | 165/79 |
| 3,792,729 | 2/1974 | Perry | 165/176 |
| 3,823,770 | 7/1974 | Duell et al. | 165/76 |

*Primary Examiner*—C. J. Husar
*Assistant Examiner*—Daniel J. O'Connor
*Attorney, Agent, or Firm*—Karl F. Ross; Herbert Dubno

[57] ABSTRACT

An apparatus for heating and/or cooling air has an upright housing through which at least two feed riser pipes and one condensate riser pipe pass. This housing has an outlet opening at its top and an inlet opening adjacent its base, this latter being provided with a hinged access door. A drip pan sealing the base of the housing drains into the condensate riser. A heat-exchanger assembly comprising a heat-exchanger coil, a trough below the coil which catches condensate and empties into the drip pan, valve for controlling liquid flow through the coil, a blower for forcing air through the coil, and thermostatic controls for operating the valves is hung in the housing between the openings. Releasable couplings connect the coil through shutoff valves to the riser pipes, and releasable electrical connectors interconnect these valves to the thermostat switch. The blower hangs on the coil assembly on a shelf and this coil assembly is hung on a support rail on the back of the housing, so that the entire device can be quickly and easily disassembled for servicing.

2 Claims, 12 Drawing Figures

HEATING AND COOLING APPARATUS

This is a division of application Ser. No. 447,784, filed Mar. 4, 1974, now U.S. Pat. No. 3,908,750.

FIELD OF THE INVENTION

The present invention relates to an air-conditioner. More specifically this invention concerns an apparatus for heating and/or cooling which is connected to hot and/or chilled-water pipes.

BACKGROUND OF THE INVENTION

Air-conditioning units are known which are connected between sets of riser pipes and which allow the temperature adjacent each unit to be controlled individually without affecting the operation of the other units connected to the same riser pipes. Such units include a heat-exchanger coil connectable to the riser pipes through thermostatically controlled motorized or solenoid valves, and a blower for forcing air through this coil at a steady rate. As a general rule the fan runs continuously to circulate the air, and even filter it, while the temperature of the coil is varied. It is possible to use a so-called two-pipe system for both heating and cooling by providing a closed-cycle refrigerator unit in the device which has a condenser coil cooled by the water which is simultaneously hot enough to be used for heating in an adjacent unit. Otherwise in a two-pipe system the standard procedure is simply to run chilled water through the pipes in the summer and hot water in the winter, with suitable controls on the thermostat for the seasonal switchover. In four-pipe systems use is made of motorized zone valves which allow one unit to be used for heating while another is used for cooling.

Such devices present considerable advantages, especially in rental buildings. Each tenant has control of his own heating and/or cooling which is very desireable especially in commercial structures where, for example, machine-filled rooms might need air conditioning practically year-round while store-rooms might be left totally unheated and uncooled for economy reasons, at the option of the tenant.

A considerable disadvantage, of such a system is that when a unit fails it often requires considerable technical skill to repair it. The entire system must be shut down to allow the unit to be serviced, and even then the person in control of the unit is frequently left without heating or cooling for a protracted period until the repair person can do the job.

OBJECTS OF THE INVENTION

It is therefore an object of the present invention to provide an improved apparatus of the general type described for heating and/or cooling.

Another object is the provision of such an apparatus which is easy to service and which at the same time is simple and inexpensive to manufacture and install.

SUMMARY OF THE INVENTION

These objects are attained according to the present invention in an apparatus for heating and/or cooling air which has a vertically elongated housing through which at least two vertical riser pipes pass. This housing is formed adjacent one end with an inlet opening and adjacent its other end with an outlet opening. A heat-exchanger is hung in the housing between the two openings and is connected to the risers by means of releasable fittings. A separate blower unit is releasably mounted on the heat-exchanger and is electrically connected to the control valves and to the source of power through releasable electrical connectors. The control unit basically comprising the thermostat and the mode-high medium or low blower speed-switches can be mounted either on the heat-exchanger or on the blower. The heat-exchanger, blowing and control unit form a heat-exchanger assembly which is hung in the housing.

According to another feature of this invention the heat-exchanger is hung on the unit between the two openings, and the blower is hung on the heat-exchanger substantially at the level of the lower openings, which is provided with a door. The controls are mounted on the blower and are accessible through the lower input openings.

In accordance with further features of this invention the control valves are provided on the heat-exchanger and are connected through conduits capable of flexing sufficiently to take up the longitudinal creep resulting from the heating and cooling of the riser pipes. These conduits can be flexible hydraulic tubing, or tromboned copper tubing.

According to yet another feature of this invention the heat-exchanger comprises a coil arranged at an angle to the vertical so that the blower can force air up through it. A drip trough is arranged under the lower end of this coil. The housing is provided at its base with drip pan and an outlet nipple on the upper drip trough is fitted with a piece of flexible tubing that hangs down and drains into the lower drip pan. This lower drip pan is connected to a condensate riser which runs up through the unit along with the feed risers. The pan fits completely across the bottom of the housing so that any dripping or leaking is caught by it, thereby eliminating the possibility of water damage near the unit.

The riser pipes according to another feature of the present invention are secured together as a unit adapted to extend vertically up through one floor, being connected above and below to similar units on the neighboring floors. This riser-pipe assembly comprises a sheet-metal jacket in which the pipes are secured by means of clamps which hold them in place during shipping, installation, and erection but which permit longitudinal displacement of these pipes caused by thermal expansion and contraction of the finished installation. The unit that is connected to this riser-pipe assembly is attached thereto preferably before shipment to the site but possibly after the greater part of the building construction is completed so that it is not damaged. Such hookup is an extremely rapid procedure for the steamfitters.

DESCRIPTION OF THE DRAWING

The above and other objects, features, and advantages will become more apparent from the following with reference to the accompanying drawing in which.

SPECIFIC DESCRIPTION

Figure 2:
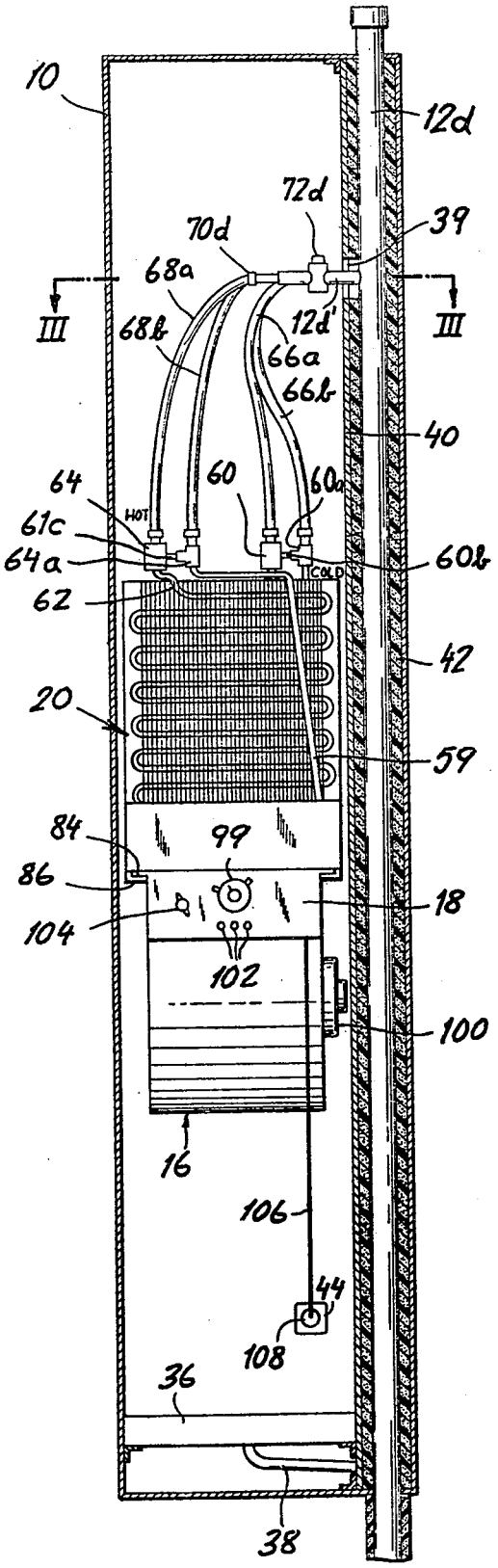
FIGS. 2 and 3 are sections taken along lines II—II and III—III of FIGS. 1 and 2, respectively.
Figure 1:
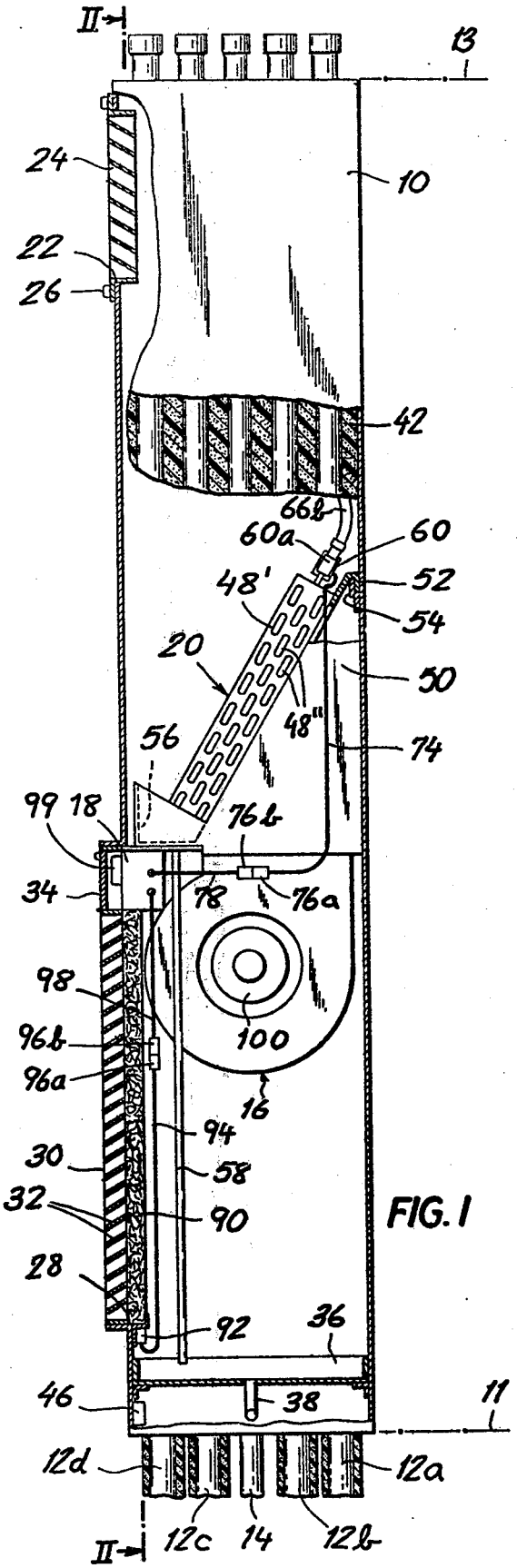
FIG. 1 is a vertical section through an apparatus according to the present invention.
Figure 4:
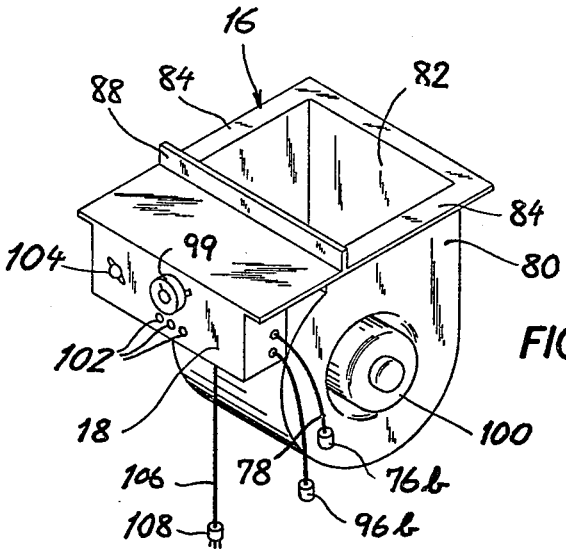
FIG. 4 is a perspective view of the blower-control unit.
Figure 3:
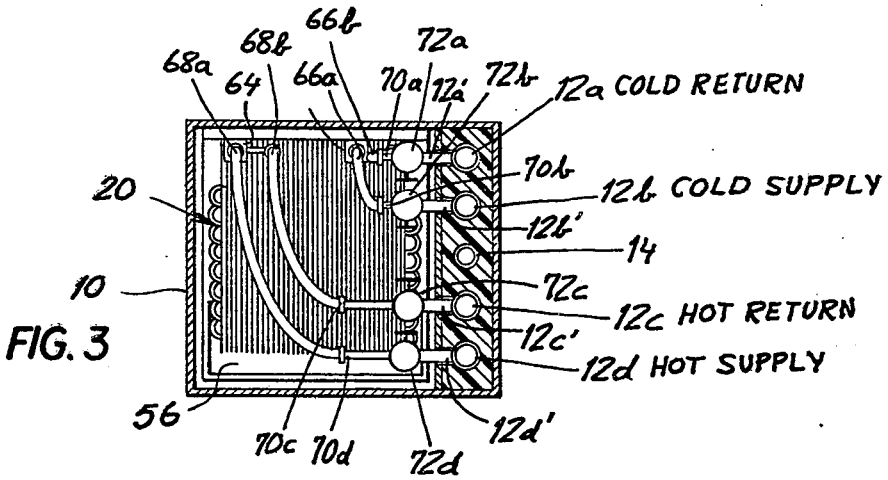
Figure 5:
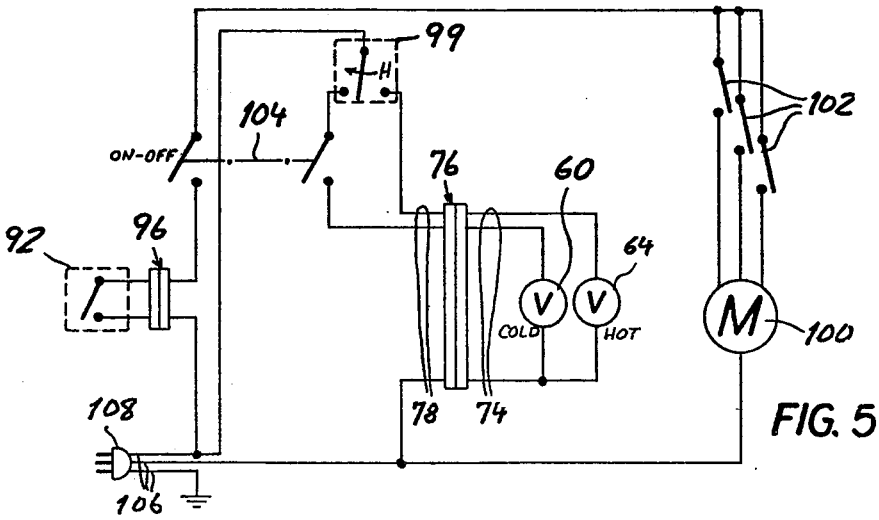
FIG. 5 is a schematic view of the apparatus.

The heating-cooling unit according to this invention has an upright hollow housing 10 formed of sheet metal and positioned above the floor 11 and to a height 13 below the ceiling. Four riser pipes 12*a–d* pass vertically through this housing adjacent one of the side walls thereof, along with a PVC condensate riser pipe 14. Within the housing 10 the blower unit 16 is provided with a control box 18 to force air up through a heat exchanger 20 attached to both the cold-water pipes 12*a*, 12*b* and the hot-water pipes 12*c*, 12*d*.

The housing 10 is rectangular in cross section and has a relatively small upper outlet opening 22 over which a louver 24 is hinged. This same front side of the housing 10 is formed near its base with a much larger inlet and access opening 28 which is normally covered by a hinged door 30 provided with louvers 32 over most of its height and having a control-access panel 34 at its top. The very base of the housing 10 is provided with a drip pan 36 connected via a short length of pipe 38 to the drain riser 14. Thus any condensation or the like in the housing is automatically led away.

The riser pipes 12*a–d* and 14 are contained at one side of the housing behind a wall 40 in a mass 42 of polyurethane foam formed in place. These pipes are supplied with the unit, projecting sufficiently so that they may be sweated together between the floors.

One wall also carries an outlet box 44 which is wired into the wiring of the building, and a courtesy outlet 46 may be provided on the front wall of the housing 10. Each of the riser pipes is provided with a respective laterally projecting nipple 12*a'–d'* which passes through a respective vertical slot 39 in the wall 40. The pipes 12*b* and 12*d* are under greater pressure than the pipes 12*a* and 12*c*, so that the flow will be from the former to the latter. A boiler is connected between pipes 12*c* and 12*d* and a chiller between pipes 12*a* and 12*b*.

The heat-exchanger 20 comprises a conventional coil unit with two sets of separate coils 48' and 48'', the former being only a single upper layer for heating and the latter being a double lower layer for cooling. This assembly is arranged at an angle to the vertical and is carried between two side walls 50 between which a rail 52 is provided which engages under downwardly extending lip or rail 54 attached to the back wall of the housing 10. Hooks and eyes can be used in place of the lips 52 and 54. Thus the entire heat-exchanger 20 is simply hung in the housing 10 with the straight back edges of its sides 50 lying against the back wall of this housing 10. The exchanger 20 is further formed at the base of the coils 48' and 48'' with a trough 56 that catches condensate running down the coil 48''. The bottom of this trough is formed with a nipple over which is secured a short length 58 of flexible tubing whose lower end lies in the drain pan 36 so that any condensate running off the coils 48' and 48'' is first caught in the trough 56 and thence drains out into the pan 36.

One side of the coil 48'' is connectable through a valve 60 and a hose 66*a* with the cold-water supply line 12*b* and the other side is connected through a Y-connector 60*a* and a hose 66*b* to the cold return line 12*a*. This valve 60 has a lateral bypass 60*b* connected to the Y 60*a* so that it can either divert the cold water through the coil 48'' or through this bypass 60*b*. Similarly the one side of the coil 48' is connectable through a line 62, a valve 64 and a hose 68*a* with the hot-water supply line 12*d* and the other side through a line 59, a Y 64*a* and a hose 68*b* to the hot-water return 12*c*. The valve 64 also has a bypass connection 64*b* connected to the Y 64*a* so that it can pass hot water either through the coil 48' or past it. The valves 60 and 64 are of the motor-operated type which when energized connect up their respective coils 48' and 48'' but otherwise bypass these coils.

These hoses 68*a*, 68*b*, 66*a* and 66*b* are connected at their ends opposite valves 64 and 60 with releasable hose couplings 70*a–d* to the risers 12*a–d* so that the heat exchanger 20 may be readily disconnected. Between couplings 70*a–*70*d* and respective runouts 12*a'–*12*d'* there are provided respective manual shutoff valves 72*a–*72*d*. The electrical connections for the solenoids of valves 60 and 64 are made with a cable 74 having a male connector 76*a* adapted to mate with a female connector 76*b* carried on the end of a cable 78 extending from the control unit 18.

The blower 16 is of the axial-input radial-output or so-called squirrel-cage type and has a housing 80 formed with an outlet opening 82 and a pair of oppositely directed flanges 84. The side walls 50 of the heat-exchanger are bent over at their lower edges to have short inwardly directed lips 86 forming a sort of shelf. The edges 84 of the blower housing 80 overlie these lips 86 so that this blower unit 16 may be hung on the heat-exchanger 20. The two are mounted together after the heat-exchanger is hung on the cleat 54 by simply sliding the lips 84 horizontally into place over the edges 86. A vertical flange or lip 88 is provided on the housing 80 which lies against the front of the heat exchanger 20 and prevents air from being blown over the control unit 18. Air drawn into the sides of the blower 16 is blown out the mouth 82 of this blower and through the heat-exchanger 20, whence it passes out of the housing 10 through the outlet 22. This air is drawn in through the louvered door 30 through a filter 90 which rests on a switch 92 connected via a two-conductor wire 94 to a male connector 96*a* plugged into a female connector 96*b* connected via a wire 98 to the control box 18. This switch 92 is closed only when a filter is in place.

The control unit 18 comprises basically a thermostatic switch 99 which is of the SPDT type that closes one circuit below a preset temperature and another circuit above a preset temperature, the former circuit operating the zone valve 64 that effects a flow of hot water through the heat-exchanger coil 48' and the latter circuit effecting a flow of cold water through the double heat-exchanger coil 48'' by activating zone valve 60. In between these two positions, neither valve 60 or 64 is activated and neither hot nor cold water can flow through the coil 48' or 48''. Since the amount of water flowing through the unit at all times is the same, there is no pressure fluctuation when a unit cuts in.

The motor 100 of the blower can be operated in three modes — high, medium, or low — by switches 102 below the thermostat 94. An ON-OFF switch 104 has two poles, one connected in series with the filter switch and lockout 92 and the other in series with the coding valve 60 so that when switch 104 is opened the blower motor 100 cannot be operated and cold water cannot flow through the coil 48''. Hot water is, however, always passed through the coil 48' whenever the ambient temperature is less than that in the thermostat, so that the water in the unit cannot freeze. Obviously, so long as the blower is not operating the amount of heat dissipated by the unit is minimal. The control box 18 has a line cord 106 which terminates in a conventional three-prong plug 108 which is plugged into the outlet box 44 in the base of the unit.

Figure 6:
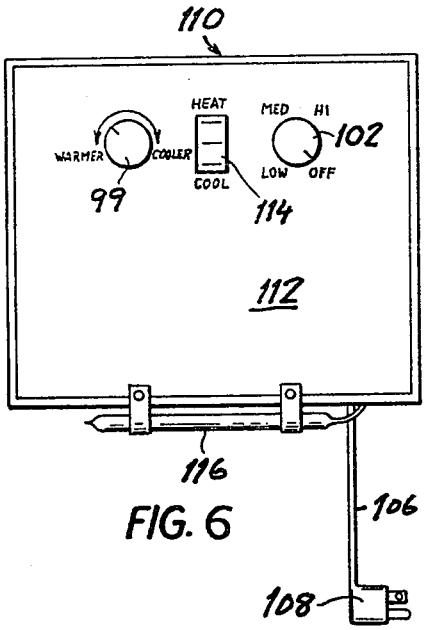
FIGS. 6, 7 and 8 are front, side, and back views, respectively, of a removable control unit according to this invention.
Figure 7:
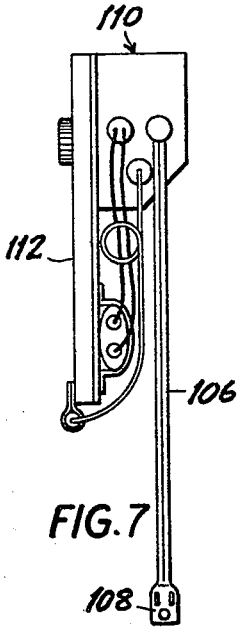
Figure 8:
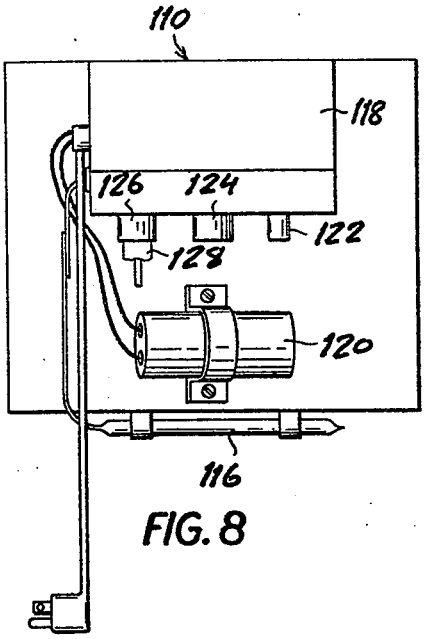
Figure 10:
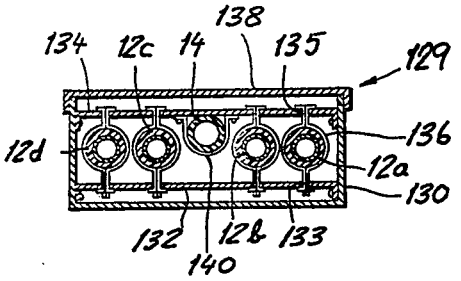
FIG. 10 is a section taken along line X—X of FIG. 9.
Figure 9:
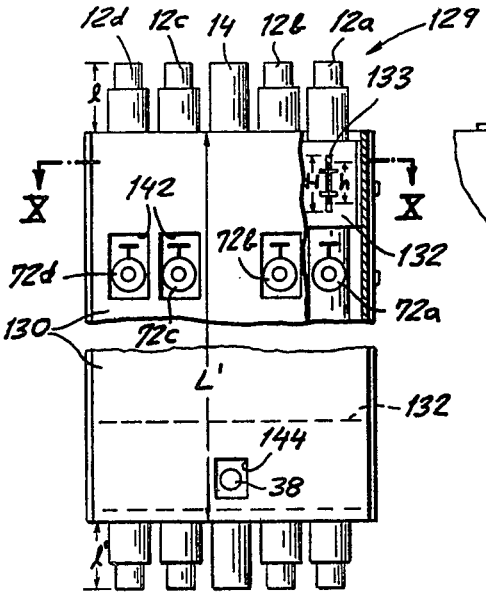
FIG. 9 is an elevational view partly broken away of an independent riser-pipe assembly according to this invention.

FIGS. 6, 7 and 8 show another type of control unit 110 having a front panel 112 on which are mounted the thermostat 99, the blower speed control switch 102, and a winter-summer switch 114 which is only effective in two-pipe systems and serves to connect the sole zone valve up to the thermostat in a manner for controlled heating or cooling. A thermostat element 116 is secured to the bottom edge of the panel 112 so that when this panel is secured in the upper region of the lower access opening 28 in the housing 10 by means of screws the returning air passes over the element 116. On the back of the panel 112 is mounted the control box 118 housing the various circuit elements except for the large condenser 120 of motor 100. The box 118 is provided with three female connectors 112, 124 and 126 into which plug the male connectors 96*a* from lockout switch 92, male plug 76*a* from the valves 60 and 64 and a male plug 128 from the blower motor 100. This unit is separate from the blower unit 16 so that it can be replaced independently therefrom. The thermostat 99 and/or its element 116 can be mounted on the outside of the housing 10, or can be mounted completely away from this housing 10.

The apparatus described above is manufactured and delivered to the building site complete, with only some blocking in the unit to protect it during transit. It is set in place and the units are mounted one atop the other on succeeding floors of the structure. The electrical box 44 is connected when the building is wired.

FIGS. 9–12 show how the insulated riser pipes 12*a–d* as well as the condensate riser 14 are received in a sheet-metal channel 130 having a length L corresponding to a distance of about 80 inches above the floor 11 and toward ceiling 13 in the finished building. The pipes extend above this channel or jacket 130 by a distance *l* and below it by a distance *l'* which are together equal to slightly less than the distance from one ceiling level 13 to the immediately adjacent overhead floor level 11. In this manner the assembly 129 shown in FIG. 9 can be placed in an unfinished building and the tubing ends can be connected together by sweating in the case of pipes 12*a–d* and by gluing for the pipe 14.

The channel is provided at its top and bottom with transverse support plates 132 each formed with four slots 133 corresponding to the pipes 12*a–d.* Clamp elements 136 each have a semicylindrical central portion 136*a* on one side of which is a bent-over foot 136*b* and on the other side of which is a straight slotted extension 136*c.* The feet 136*b* of two such elements 136 are fitted side-by-side into one of the slots 133 and the elements 136 are spread to allow one of the pipes 12*a–d* to be fit between them. Thereafter another guide plate 134 formed with slots 135 is fit over the front of the arrangement, with the extensions 136*c* projecting through the slots 135. The corners 136*d* of the extensions 136*c* are then bent over to hold the elements 136 and pipes in place. The radius of curvature of the sections 136*a* is slightly less than that of the pipes 12*a–d* so that these pipes will be snugly held. At the same time the elements 136 have a height *h* which is less than the height H of the slots 133 and 135 so that limited longitudinal displacement of the pipes 12*a–d* is possible. The riser 14 is simply held in place by a conventional pipe clamp or strap 140 since this pipe does not undergo sufficient thermal expansion or contraction. A large cover plate 138 is thereafter fastened over the front of the channel 130 to completely surround the pipes 12*a–d* and 14. All of the parts 130, 132, 134, 136, 138 and 140 are made of sheet metal and are secured together where necessary by rivets or spot-welds. In this manner the riser-pipe assembly 129 for one floor forms a neat unit which is easily installed and which permits an easy hookup of the various elements at a later time. The housing 10 of the unit used with such an assembly 129 is correspondingly reduced in depth, so that the plate 138 lies against its wall 40 with the valves 72*a–d* passing through corresponding holes 142 in the channel 130, with the pipe 38 passing through a hole 144. With this arrangement there is the possibility of limited displacement of the pipes 12*a–d* both longitudinally relative to the jacket 130 and transversely relative thereto. This allows for thermal expansion and contraction of these pipes while making it possible to shift them limitedly when securing them together.

The clips 136 serve to center the riser pipes regardless of their diameter. Thus a riser-pipe assembly used in the upper stories of a building, which is therefore of lesser diameter than the risers in the lower stories, is centered in line with the overhead and underneath risers. The flexibility of these clips facilitates this centering.

Figure 11:
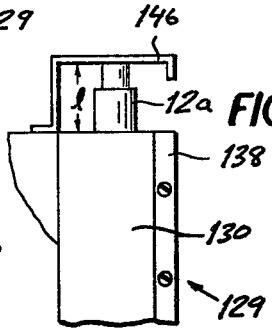
FIG. 11 is a side view of the upper part of the assembly of FIG. 9, illustrating a pipe gauge and shield.
Figure 12:
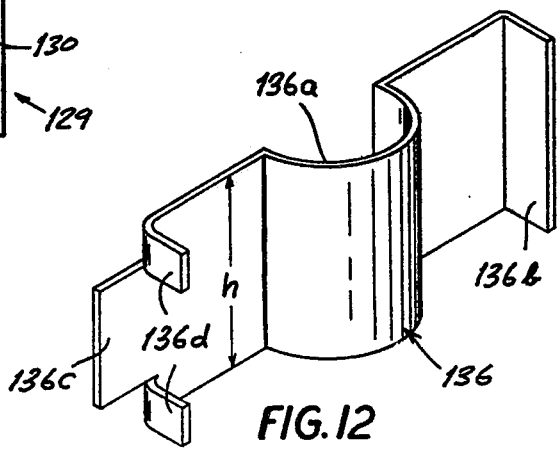
FIG. 12 is a perspective view of a clamp element used in the assembly of FIG. 9.

FIG. 11 shows a throwaway pipe protector and gauge 146 which is decured to the top wall of the housing 10 and is removed when the unit is ready to be installed in place. This shield element 146 is generally L-shaped and is releasably secured to the unit 129. Such a gauge 146 is also provided at the bottom of the assembly 129.

In operation each unit can be individually controlled to heat or cool the room. In the four-pipe system described above one part of a building can be cooled while another is heated. In a more economical system there are only two riser pipes, plus the condensate drain, and either chilled water or heated water, depending on the season, is passed through them. In this case two-port rather than three-port control valves could be used with appropriate switching to establish whether the back or front contacts of the thermostat would operate them. The air that is drawn into the unit passes over the thermostat 99 so that this element operates the device to maintain the temperature without it within a narrow range. Since the blower speed, which determines the heating or cooling level, remains constant once set, even when the thermostat is not functioning to close either of the heating or cooling circuits, the unit filters the air.

It is also possible in a two-pipe system to provide the unit with a heat-pump arrangement as described in U.S. Pat. No. 3,472,313 granted on 14 October 1969 to Arther Milgram and Sidney Siegel. In this arrangement water at 120° F is pumped through the unit and is either run through a heating coil or through a condenser coil, depending on whether the unit is being employed as a heater or cooler.

Should the unit break down in some manner, it is possible to remove any of the functioning parts except the riser pipes 12*a–d* and 14. Of course the chance of failure of these nonremovable parts is very small. The blower unit 16 and the thereto attached or independent control unit 18 or 110 can be removed for servicing or replacement by opening the access door 30 and removing the filter 90. Then the plug 108 is pulled out and the various connectors are pulled apart. The motor unit 16 is then slid out horizontally. Should the malfunction be in this unit it can be replaced quickly and easily.

If the heat exchanger springs a leak or the valves 60 or 64 fail in some manner, the service person need merely close the valves 72*a–d*, then uncouple the hoses 70*a–d* after removing the blower as described above. The exchanger 20 is then lifted so that the elements 52 and 54 clear each other, its upper end is then tipped forward, and then it is dropped down and removed through the front access hole 28. This operation, which removes all of the working parts of the device, can be carried out in no more than several minutes. Since is has been found most easy in a large installation for the maintenance department to have several heat exchangers and blower-control units, it only takes a few more minutes to put completely new works in the apparatus. Thereafter the defective parts of the subassemblies can be repaired in the shop at the convenience of the repair person. No costly and irritating layup time need be experienced, so that the users of a system employing units according to the present invention will not only have individually controllable heating and cooling the year round, but will not be left for long periods of time without either heating or cooling in case of the inevitable equipment failure.

I claim:

1. A riser-pipe assembly for an air-treatment apparatus, said assembly comprising:

at least two upright riser pipes;

a pair of plates flanking said pipies and each formed adjacent each pipe with a respective upright slit in line with the respective pipe and having a predetermined vertical length; and at least four resiliently deformable elongated clamp strips arranged in two pairs bridging said plates and each embracing a respective pipe, each strip having one end engaged in a slit of one plate and another end engaged in the corresponding slit of the other plate, said strips each having a vertical height substantially less than said predetermined height of said slits, whereby said pipes and said strips are vertically displaceable relative to said plates, each of said strips having a generally cylindrically arcuate center region and at each end a generally planar region extending through the respective slit and formed with a bent-over portion preventing withdrawal from said slit, the bent-over portions at each slit extending in opposite directions.

2. The assembly defined in claim 1 wherein said strips are made of sheet metal.

* * * * *